United States Patent [19]

Asayama

[11] 3,973,409

[45] Aug. 10, 1976

[54] APPARATUS FOR ESTABLISHING AN ANCHOR

[75] Inventor: Kingo Asayama, Hirakata, Japan

[73] Assignee: Kabushiki Kaisha Takechi Koumusho, Osaka, Japan

[22] Filed: July 5, 1974

[21] Appl. No.: 485,777

[52] U.S. Cl. ..... 61/39; 61/45 B; 61/53.6; 61/53.64; 52/157; 175/292

[51] Int. Cl.[2] ..... E21D 20/02; E02D 5/74; E21B 9/30

[58] Field of Search ..... 61/39, 53.6, 53.52, 61/53.56, 53.62, 53.64, 53.66, 35; 52/223, 727; 175/292

[56] References Cited

UNITED STATES PATENTS

| | | | |
|---|---|---|---|
| 3,363,422 | 1/1968 | Turzillo | 61/53.66 |
| 3,494,133 | 2/1970 | Ahlgren et al. | 61/39 X |
| 3,665,717 | 5/1972 | Sweeney et al. | 61/39 |
| 3,833,706 | 9/1974 | Edwards | 52/223 X |

FOREIGN PATENTS OR APPLICATIONS

| | | | |
|---|---|---|---|
| 1,484,392 | 6/1969 | Germany | 61/536 |

*Primary Examiner*—Jacob Shapiro
*Attorney, Agent, or Firm*—Price, Heneveld, Huizenga & Cooper

[57] ABSTRACT

A method for establishing an anchor inside of a retaining wall is described; in which an auger bore is excavated through said retaining wall with an earth auger and thereafter by reversing the rotation of said earth auger an enlarged bore is formed at the extreme end portion of said auger bore; and in which an auger head and an auger shaft are separated from each other to leave an anchor plate formed integrally with said auger head as well as a rod connected to said anchor plate within the enlarged bore and the auger bore, and then mortar is filled in these bores to establish an anchor made of concrete in the earth. In one preferred embodiment of the invention, the rod and the anchor plate are connected to each other by fastening with a nut, this connecting portion being enclosed in a box, and also the peripheral surface of said rod is coated with a synthetic resin film, whereby a provision is preliminarily made such that the rod may be easily extracted from the anchor after the use of the anchor has ended. Also an apparatus for practicing the aforementioned method is described.

3 Claims, 16 Drawing Figures

APPARATUS FOR ESTABLISHING AN ANCHOR

BACKGROUND OF THE INVENTION

The present invention relates to a method and apparatus for establishing an anchor inside of a retaining wall to prevent a retaining wall surrounding a raised portion of ground or a retaining wall surrounding a vacant space formed below ground surface from tumbling down, that is, to increase the resistance against external forces exerted upon a retaining wall in the direction of causing the retaining wall to tumble down.

In the case of an anchor for increasing resistance against lateral pressure exerted upon a retaining wall on a side surface of a precipice, that is, upon a precipice retaining wall, that is established in an oblique direction with respect to the precipice retaining wall, the extreme end portion of said anchor must be supported by any means in the earth. However, since said support end portion is substantially distant from the outer surface of the precipice retaining wall, the work of establishing such a support is extremely difficult.

It is an object of the present invention to provide a novel method and apparatus for establishing an anchor which makes it possible to easily form an anchor having a bulb-shaped support portion having a very high withdrawal resistance within the ground remote from a retaining wall.

Another object of the invention is to provide a novel method and apparatus for reducing the rotational resistance incident to excavating an auger bore in the ground by means of an earth auger.

Still another object of the invention is to provide a method and means for facilitating the operation of disconnecting a rod from an anchor and withdrawing the same after the use of the anchor has ended.

Yet another object of the invention is to provide a method and means for facilitating the adjustment of the driving direction of an earth auger with respect to a retaining wall surface.

According to one feature of the present invention, a method and apparatus for establishing an anchor is characterized in that an auger bore is excavated through and inside of a retaining wall with an earth auger while expansible blades provided just above an auger head are contracted, thereafter the expansible blades are expanded by reversing the rotation of the earth auger to form an enlarged bore having a larger diameter at the extreme end portion of said auger bore by means of said expansible blades, an auger shaft is separated from the auger head and withdrawn out of the auger bore while leaving an anchor plate formed integrally with said auger head as well as a rod connected to said anchor plate within the enlarged bore and the auger bore, and then mortar is filled in said enlarged bore and said auger bore, whereby an anchor made of concrete and having a bulb-shaped enlarged portion at its extreme end may be established.

These and other objects and features of the present invention will become more apparent by reference to the following description taken in conjunction with the accompanying drawings, in which:

IN THE PREFERRED EMBODIMENT

Figure 1:
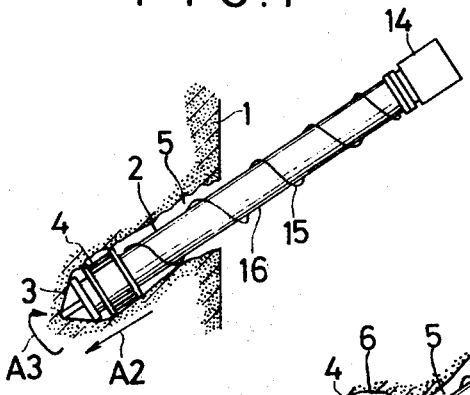
FIGS. 1 through 5 are side views partially in cross-section, respectively showing the successive steps upon establishing an anchor by practicing the working method according to the present invention.
Figure 2:
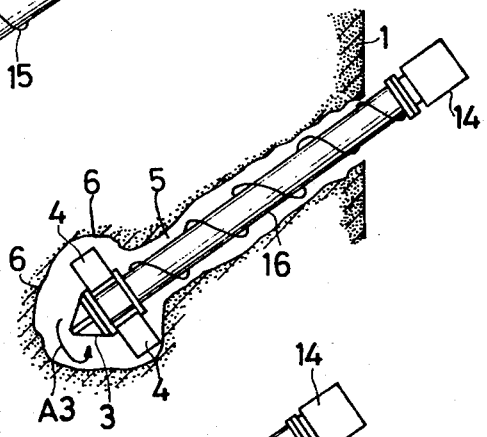

Referring now to the drawings, reference numeral 1 designates a retaining wall such as that formed along a precipice or that formed surrounding an underground space. At first, an auger bore is excavated through this retaining wall 1 from its outside towards its inside in an obliquely downward direction represented by arrow A2 by means of an earth auger 2, as shown in FIG. 1. Then the earth auger 2 is rotated in the direction of arrow A3 to keep its expansible blades 4 in a contracted condition as will be fully described later with reference to FIGS. 6 to 8. After the earth auger 2 has reached a predetermined depth, the earth auger is reversely rotated in the direction of arrow A3 to expand the expansible blades 4 provided just above an auger head 3 of the earth auger 2 with the mechanism as fully described later, as shown in FIG. 2, whereby an enlarged bore 6 having a larger diameter than the auger bore 5 drilled by the earth auger can be formed in the ground by means of the expansible blades 4.

Figure 3:
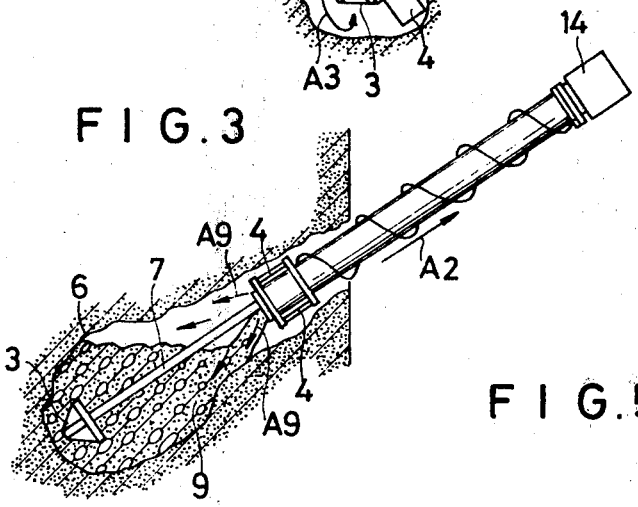

After formation of the enlarged bore 6, the earth auger 2 is again rotated in the direction of arrow A3 to contract the expansible blades 4 again, and the earth auger 2 is withdrawn in the direction of arrow A2 in FIG. 3 while being rotated in the same direction. Then the auger head 3 and a rod 7 connected thereto are left in the ground.

While the earth auger 2 is withdrawn, mortar 9 is filled within the enlarged bore 6 and the auger bore 5 through an inner space 8 (See FIG. 7) of the earth auger 2. In FIG. 3, arrows A9 show the directions of the flows of mortar. The earth auger 2 is completely withdrawn from the auger bore 5, while the auger head 3, the rod 7 having its one end connected to said head 3 and the mortar filler 9 are left in the enlarged bore 6 and the auger bore 5, and then a metallic retainer 10 is mounted at the tip end of the rod 7 with a bolt 11.

Figure 4:
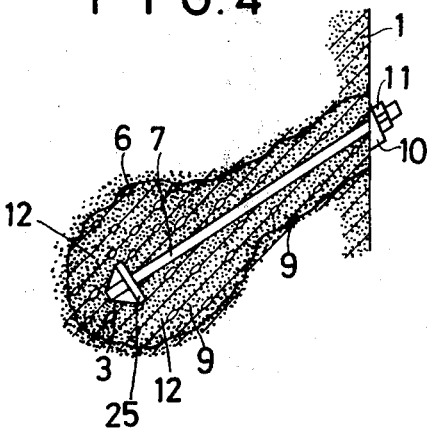

Under the above-described condition, the mortar 9 is hardened, and thereby an anchor made of concrete having a bulb-shaped enlarged portion 12 at its extreme end is formed in the ground as shown in FIG. 4. The anchor formed through the aforementioned process has a very large resistance against a withdrawing force in its lengthwise direction because a bulb-shaped, enlarged portion 12 is provided at its extreme end. In this manner it can prevent the retaining wall from tumbling.

Figure 5:
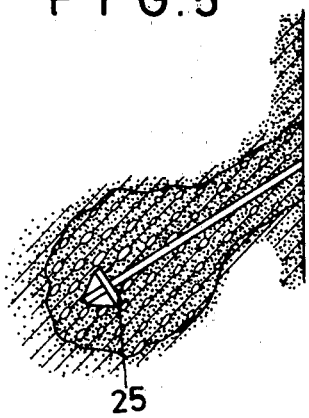

When the requirement for said concrete anchor has been eliminated after the working in the space surrounded by the retaining wall 1 is finished, the rod 7 is disconnected from the head 3 and withdrawn externally. This final condition is shown in FIG. 5.

In addition, reference numeral 14 designates a motor associated with reduction gears for rotating the earth auger 2, numeral 15 designates a screw-shaped blade, and numeral 16 designates an auger shaft.

Figure 6:
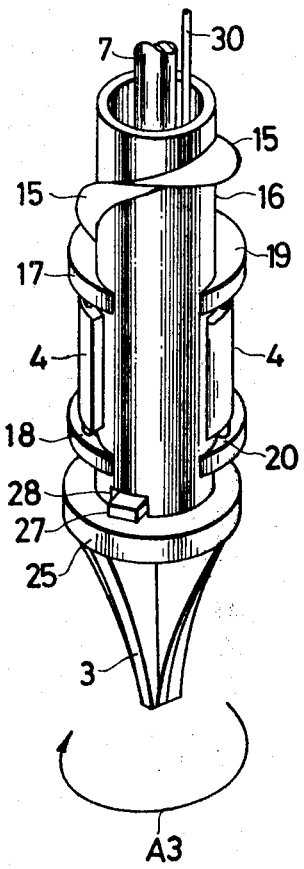
FIG. 6 is an enlarged perspective view of a part of the earth auger shown in FIG. 1.
Figure 7:
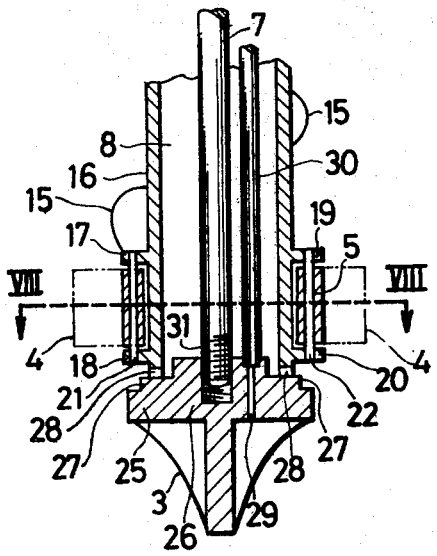
FIG. 7 is a longitudinal cross-section view of the part shown in FIG. 6.
Figure 8:
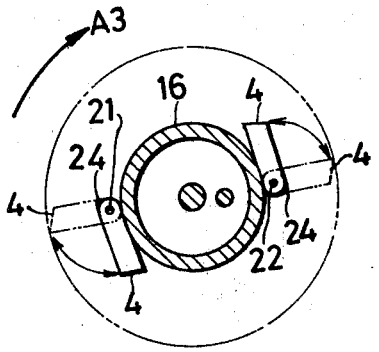
FIG. 8 is a transverse cross-section view of the same taken along line VIII—VIII in FIG. 7.

A more detailed structure of the expansible blades 4 is shown in FIGS. 6 to 8. In the proximity of the tip end of the auger shaft 16 are provided two pairs of protrusions 17–18 and 19–20 in diametrically opposite positions to each other. Between said protrusions 17 and 18 is pivotally mounted one of the expansible blades 4 at its base portion with a pin 21, while between said protrusions 19 and 20 is pivotably mounted the other expansible blade 4 at its base portion with a pin 22. At the base portion of each of the expansible blades 4 a stop 24 is formed, so that when the expansible blades 4 rotate about the respective pins 21 and 22 from the positions shown by solid lines to the extended position shown by dash-dot lines as illustrated in FIG. 8, said stops 24 strike against the outer circumferential surface of the auger shaft 16 to prevent further rotation of said blades 4.

Since the expansible blades 4 have the above-described structure, upon rotating the earth auger 2 in the direction of arrow A3, the expansible blades 4 cannot expand because of the resistance of the earth, while upon rotating the earth auger 2 in the direction opposite to the direction of arrow A3 (in the direction of arrow A3 in FIG. 2), the earth strikes against the tip ends of the blades 4 resulting in expansion of said blades 4 out to the positions shown by dash-dot lines in FIGS. 7 and 8.

The auger head 3 consists of a cutter blade portion and an anchor plate 25. From a boss portion 26 of said anchor plate 25 project keys or claws 27. Said claws 27 are adapted to be detachably engaged with recesses 28 formed at the bottom end of the auger shaft 16. When the auger shaft 16 and the anchor plate 25 are placed in the relative position as shown in FIG. 1 or 2, the claws 27 and the recesses 28 are engaged with each other, but when they are placed in the relative position as shown in FIG. 3, the claws 27 and the recesses 28 are disengaged from each other.

In addition, a water injection port 29 is formed in the anchor plate 25, and therefore, if water fed through a water feed pipe 30 provided within the auger shaft 16, is injected from said port 29 under the conditions shown in FIGS. 1 and 2, it is possible to reduce the friction between the earth auger 2 and the earth during the boring work, and thereby enhance the efficiency of the boring work.

Still further, if the boss 26 of the anchor plate 25 and the rod 7 are connected to each other through screw threads, then upon leaving only the anchor plate 25 in the earth, the two members can be separated from each other by merely twisting the rod 7.

Another embodiment of the earth auger according to the present invention is shown in FIGS. 9 to 12, in which a motor associated with reduction gears 14 and the top end of an earth auger shaft 16 are coupled through a drive shaft 32, a clutch 33 and a box joint 34, and the top end of the rod 7 and the joint 34 are connected with a fastening nut 35. On the lower surface of the anchor plate 25 of the auger head 3 is provided a box 36 in which the bottom end of the rod 7 is projected to be fastened by a nut 37, and the bottom end of the box 36 is enclosed with a lid 38 in a perfectly sealed manner as by welding.

On the upper surface of the anchor plate 25 is superposed a clutch plate 39. Engaging protrusions 40 projected from the lower surface of the clutch plate 39 and recesses 41 drilled in the anchor plate 25 are detachably fitted to each other. The bottom end of the auger shaft 16 is fixedly secured to the upper surface of the clutch plate 39. Accordingly, by fastening the nut 35 at the top end of the rod 7 as well as the nut 37 at the bottom end thereof, it is possible to integrally connect the box joint 34, auger shaft 16, clutch plate 39 and anchor plate 25 disposed between these nuts 35 and 37. It is to be noted that at one corner of the clutch 39, in place of the engaging protrusion 40, the lower end of a water feed pipe 31 is provided, penetrating through the clutch plate 39, is detachably fitted in a bore 42 drilled through the anchor plate 25. In this modified embodiment, members given the same reference numerals as those shown in FIGS. 1 to 8 have like functions.

Figure 9:
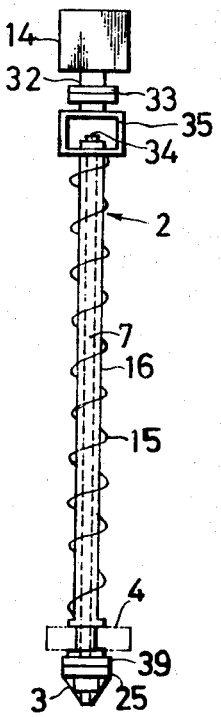
FIG. 9 is a side view of an earth auger according to another embodiment of the present invention.
Figure 10:
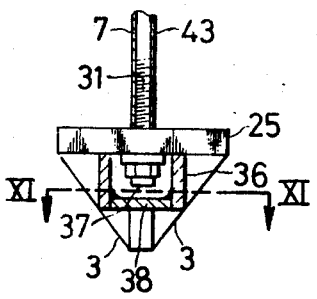
FIG. 10 is an enlarged longitudinal cross-section view of a part of the earth auger shown in FIG. 9.
Figure 11:
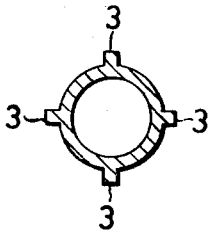
FIG. 11 is a transverse cross-section view of the same taken along line XI—XI in FIG. 10.
Figure 12:
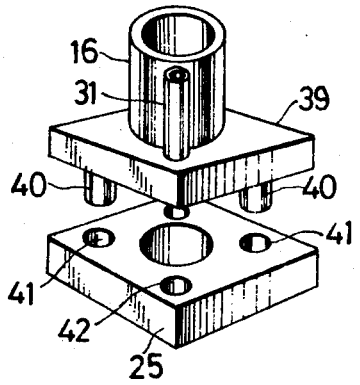
FIG. 12 is an enlarged perspective view of another part of the earth auger shown in FIG. 9.

In the case of employing the earth auger 2 shown in FIG. 9, upon leaving the auger head 3 and the rod 7 in the earth and withdrawing the remaining portions of the earth auger 2 as shown in FIG. 3, the threaded engagement between the nut 35 and the rod 7 is disconnected and then the earth auger 2 is withdrawn externally. Through this operation, the clutch plate 39 is separated from the anchor plate 25. In addition, when the anchor plate portion 25 only is left in the earth and the rod 7 is withdrawn according to this modified embodiment, the rod 7 is twisted to disconnect its threaded engagement with the nut 37 and then the rod 7 is withdrawn similarly to the process shown in FIG. 4 and FIG. 5 according to the first embodiment. In this case, since the nut 37 is sealingly enclosed within the box 36 by means of the lid 38, the portion of threaded engagement between the nut 37 and the rod 7 is neither fastened with rust nor fixedly bound by concrete even after these members have been left in the earth for a long period of time, and therefore, no obstacle exists against the disconnecting operation between the anchor plate 25 and the rod 7.

In order to prevent the nut 37 from rotating together with the rod 7, when the rod 7 is twisted the nut 37 is bound to the anchor plate 25 against rotation. Also, in order to prevent the outer circumferential surface of the rod 7 from becoming fixedly secured to the concrete, a coating layer 43 of synthetic resin such as vinyl chloride and the like is applied to the outer circumferential surface of the rod 7.

Figure 15:
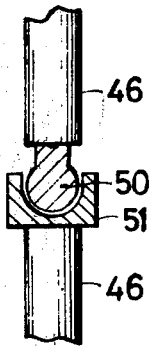
FIG. 15 is an enlarged cross-section view of a part of the apparatus in FIG. 13.

A working apparatus to be used upon advancing an earth auger into the earth or withdrawing the same out of the earth as shown in FIGS. 1 to 3, is illustrated in FIGS. 13 through 16, in which reference numeral 45 designates a pile driver, and there are provided a front support rod 46 and two rear support rods 47 in the front and at the rear of said pile driver 45, respectively. A beam 48 is provided which is supported adjacent its rear end by the support rods 47 and adjacent its front end by the support rod 46. The upper surface of the beam supports the rear end of a leader 49, while the front of the beam supports the front end of the leader 49. The front support rod 46 comprises a universal joint consisting of a ball head 50 and a ball bearing 51 as shown in FIG. 15, while the rear support rod 47 is constructed of a hydraulic actuator cylinder including a hydraulic cylinder and a hydraulic piston. The motor associated with a reduction gear 14 at the top end of the auger shaft 16 is connected to a wire 52 of a winch. Other members given the same reference numerals as those shown in FIGS. 1 to 12 have like functions.

Figure 13:
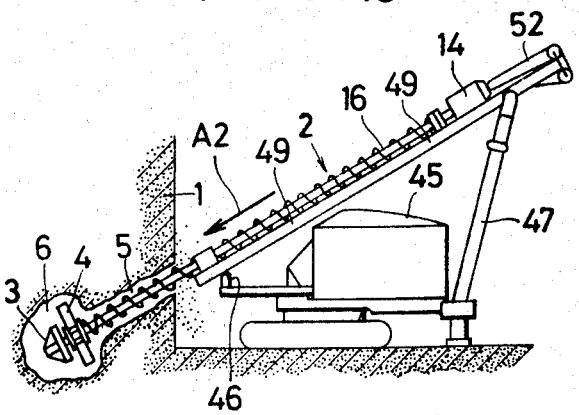
FIG. 13 is a side view of an apparatus to be used for practicing the working method according to the present invention.
Figure 16:
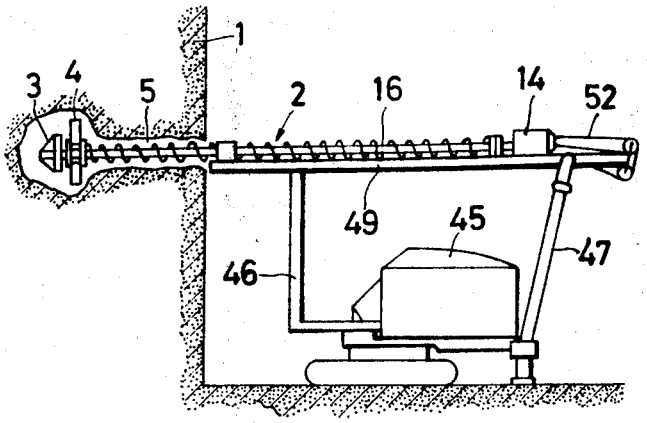
FIG. 16 is a side view showing an operating condition of a modified embodiment of the apparatus according to the present invention.
Figure 14:
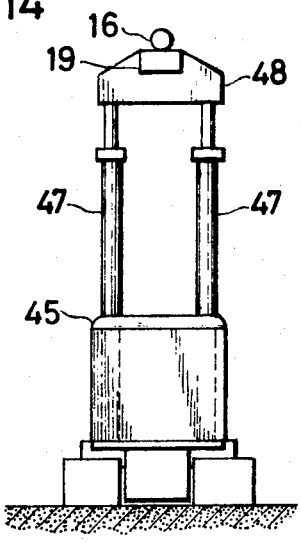
FIG. 14 is a somewhat enlarged rear elevation view of the same apparatus.

This apparatus functions to drill the auger bore 5 as well as the enlarged bore 6 through and inside of the retaining wall 1 under the condition shown in FIG. 13. Upon adjusting the angle of inclination with respect to the horizontal plane of the direction of advancement of the earth auger, the rear support rods 47 are extended or contracted by means of the hydraulic device therein to rotate the leader 49 about the fulcrum point at the ball bearing 51. Thus it is possible to excavate an auger bore 5 in any desired direction with respect to the retaining wall 1, but in case that it is desired to support the earth auger horizontally, this can be done by first extending the front support rod 46 as shown in FIG. 16.

While the present invention has been described above in connection to its preferred embodiments illustrated in the accompanying drawings, it is intended that the scope of the invention is not limited to the disclosure in the accompanying drawings, but many changes and modifications thereof can be made within the scope of the invention so long as they do not depart from the spirit of the invention as specified in the appended claims.

The embodiments of the invention in which an exclusive property or privilege is claimed are described as follows:

1. An apparatus for establishing an anchor inside a retaining wall from the outside thereof, said apparatus comprising: a hollow auger shaft and centrifugally expansible blades mounted at the lead end of said auger shaft, pivot means on said shaft hingedly connecting said blades to said auger shaft whereby said blades can assume a retracted position seated against said auger shaft when said auger shaft is rotated in one direction and said blades can assume an extended, generally radial position when said auger shaft is rotated in the opposite direction; an auger head projecting from said lead end of said auger shaft, said auger head having a ground boring lead and adapted to penetrate soil when rotated in either direction; positive interference type clutch means securing said auger head to said auger shaft for rotation therewith in both directions, said clutch disengaging said auger shaft from said auger head upon said auger shaft being withdrawn axially from said auger head; a rod extending through said auger shaft and threadedly engaging said auger head, said rod holding said auger head in positive engagement with said clutch means and said auger shaft.

2. The apparatus described in claim 1 wherein said rod is coated with a material which is a release agent for grout and seals the threaded attachment between said rod and auger head from the corrosive effects of the grout.

3. The apparatus described in claim 1 wherein a nut provides the threaded engagement between said rod and said auger head; a box enclosing said nut against moisture, earth and concrete; a coating on said rod; said coating being non-bonding with grout and forming a moisture-tight seal where said rod enters said nut.

* * * * *